US010662694B2

(12) United States Patent
Hong et al.

(10) Patent No.: US 10,662,694 B2
(45) Date of Patent: May 26, 2020

(54) NON-MODULE TYPE DUAL REGULATOR ASSEMBLY

(71) Applicants: Hyundai Motor Company, Seoul (KR); Kia Motors Corporation, Seoul (KR)

(72) Inventors: Seok-Hyun Hong, Gyeonggi-do (KR); Min-Su Kim, Seoul (KR); Sung-Won Hong, Incheon (KR); Seung-Chul Lee, Incheon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/838,902

(22) Filed: Dec. 12, 2017

(65) Prior Publication Data

US 2019/0078372 A1 Mar. 14, 2019

(30) Foreign Application Priority Data

Sep. 8, 2017 (KR) ..... 10-2017-0115090

(51) Int. Cl.
*E05F 15/689* (2015.01)
*E05F 15/686* (2015.01)
(Continued)

(52) U.S. Cl.
CPC ..... *E05F 15/689* (2015.01); *E05F 11/382* (2013.01); *E05F 11/488* (2013.01); *E05F 15/686* (2015.01); *E05F 2700/02* (2013.01); *E05Y 2201/684* (2013.01); *E05Y 2600/50* (2013.01); *E05Y 2600/53* (2013.01); *E05Y 2600/626* (2013.01); *E05Y 2600/634* (2013.01)

(58) Field of Classification Search
CPC ..... E05F 11/38; E05F 11/48; E05F 11/481; E05F 15/689
See application file for complete search history.

(56) References Cited

U.S. PATENT DOCUMENTS 4,648,206 A * 3/1987 Moriya ..... B60J 1/17 49/352
8,341,890 B2 * 1/2013 Staser ..... E05F 11/488 49/348

(Continued)

FOREIGN PATENT DOCUMENTS

DE 102004048924 A1 * 4/2006 ..... B60J 1/17
KR 2010-0011725 A 2/2010

*Primary Examiner* — Gregory J Strimbu
(74) *Attorney, Agent, or Firm* — Mintz Levin Cohn Ferris Glovsky and Popeo, P.C.; Peter F. Corless

(57) ABSTRACT

A non-module type dual regulator assembly includes a pair of guide rails that are separated from each other and disposed in a door of a vehicle along a direction that a window glass is raised or lowered. A pair of glass holders are coupled to one side of the window glass and movably disposed on the respective guide rails. An upper connection member has a plurality of ends fastened to upper portions of the guide rails. A lower connection member has a plurality of ends fastened to lower portions of the guide rails. A cable is coupled to the glass holders and circulatably disposed along the guide rails to raise or lower the glass holders in the same direction at the same time. A driving motor is disposed on the lower connection member and circulates the cable.

9 Claims, 11 Drawing Sheets

(51) Int. Cl.
*E05F 11/38* (2006.01)
*E05F 11/48* (2006.01)

(56) References Cited

U.S. PATENT DOCUMENTS

| | | | | |
|---|---|---|---|---|
| 9,580,953 | B1 * | 2/2017 | Matsushita | E05F 15/689 |
| 2002/0050099 | A1 * | 5/2002 | Marscholl | B60J 1/17 49/352 |
| 2007/0163177 | A1 * | 7/2007 | Heyer | B60J 5/0416 49/348 |
| 2007/0214726 | A1 * | 9/2007 | Graf | E05F 11/382 49/352 |
| 2013/0168488 | A1 * | 7/2013 | Debus | E05F 11/483 242/615.3 |
| 2013/0205669 | A1 * | 8/2013 | Nakamura | E05F 11/426 49/349 |
| 2013/0219794 | A1 * | 8/2013 | Nakamura | E05F 11/426 49/350 |
| 2014/0109481 | A1 * | 4/2014 | Umemura | E05F 11/483 49/352 |
| 2016/0312507 | A1 * | 10/2016 | Hayotte | B60J 5/0416 |

* cited by examiner

NON-MODULE TYPE DUAL REGULATOR ASSEMBLY

CROSS-REFERENCE TO RELATED APPLICATIONS

This application claims priority to Korean Patent Application No. 10-2017-0115090, filed on Sep. 8, 2017, which is incorporated herein by reference in its entirety.

BACKGROUND

Field of the Disclosure

The present disclosure relates to a regulator disposed in a door of a vehicle to raise and lower a window glass, and more particularly, to a non-module type dual regulator assembly which is assembled more easily and reduce operation noise.

Description of Related Art

Typically, a door of a vehicle has a window glass disposed therein, and a regulator is disposed in the door to raise and lower the window glass. The regulator is classified into a module type regulator and a non-module type regulator. The module type regulator is manufactured having a module that includes a plastic panel in which a door latch and speaker as well as the regulator are disposed therein, and then mounted in the door. The non-module type regulator is manufactured as an independent assembly.

The module type regulator generates a sound when raising and lowering a window glass, and has a substantial weight. Accordingly, the module type regulator has a disadvantage considering the production cost and weight. The non-module type regulator is divided into a single regulator and a dual regulator, based on the number of guide rails used for raising and lowering a window glass. The single regulator has one guide rail, and the dual regulator has two guide rails. Since the single regulator is unable to stably raise and lower the window glass, the dual regulator is often applied.

FIG. 1 illustrates a non-module type dual regulator assembly 100 according to the related art. The non-module type dual regulator assembly 100 includes a pair of guide rails 111, a pair of glass holders 112, a plurality of rollers 115, a cable 118 and a driving motor 117. The pair of guide rails 111 are separated from each other, the pair of glass holders 112 are coupled to one side of a window glass, and disposed on the respective guide rails 111 to slide along the guide rail 111. The plurality of rollers 115 are disposed at both ends of the guide rails 111, respectively. The cable 118 is disposed to circulate through the rollers 115 and is coupled to the glass holders 112. The driving motor 117 has a drum disposed on a rotating shaft thereof, and a component of the cable 118 is wound around the drum. The cable 118 has a tube 119 disposed thereon, the tube 119 operates to reduce noise which may be caused by a contact between the cable 118 and an inner or outer panel of a door when the cable 118 is operated.

The non-module type dual regulator assembly 100 according to the related art is difficult to assemble, since the pair of guide rails 111 are separated from each other. In order to mount the regulator assembly 100 in the door, the regulator assembly 100 must be inserted into the space between the exterior panel and the inner panel of the door. Accordingly, an operator is required to insert the regulator assembly 100, while holding the guide rail 111. The matters described as the related art have been provided merely for assisting in the understanding for the background of the present invention and should not be considered as corresponding to the related art known to those skilled in the art.

SUMMARY

An object of the present invention provides a non-module type dual regulator assembly which allows an operator to mount the regulator assembly without holding a guide rail, and reduce noise during operation.

In an aspect of an exemplary embodiment of the present disclosure, a non-module type dual regulator assembly may include a pair of guide rails separated from each other, and disposed in a door of a vehicle along a direction that a window glass is raised or lowered, a pair of glass holders coupled to one side of the window glass, and movably disposed on the respective guide rails an upper connection member having both ends fastened to upper portions of the guide rails, and connecting the upper portions of the guide rails separated from each other; a lower connection member having both ends fastened to lower portions of the guide rails, and connecting the lower portions of the guide rails separated from each other, a cable coupled to the glass holders, and circulatably disposed on the guide rails to raise or lower the glass holders in the same direction at the same time and a driving motor disposed in the lower connection member and configured to circulate the cable.

In some exemplary embodiments, each of the guide rails may have an upper fastening aperture formed at the upper portion thereof, the upper fastening aperture may be formed through the guide rail, and the upper connection member may have locking hooks formed at a plurality of ends thereof, respectively. The locking hooks may be locked into the upper fastening apertures and the locking hooks may be inserted into the upper fastening apertures to couple the guide rails and the upper connection member to each other.

In another exemplary embodiment, each of the guide rails may have an upper insertion component formed at one side of the upper portion thereof, and the upper insertion component may have a flat surface. The upper connection member may have insertion grooves into which the respective upper insertion components are inserted, and the upper insertion components may be inserted into the insertion grooves to enable the upper connection member to support the guide rails.

Each of the guide rails may have a lower fastening aperture formed at the lower portion thereof, the lower fastening aperture may be formed through the guide rail. The lower connection member may have locking hooks formed at a plurality of ends thereof, respectively, the locking hooks may be locked to the lower fastening apertures, and the locking hooks may be inserted into the lower fastening apertures to couple the guide rails and the lower connection member to each other.

Each of the guide rails may have a lower insertion component formed at one side of the lower portion thereof and the lower insertion component may have a flat surface. The lower connection member may have insertion grooves into which the respective lower insertion components are inserted and the lower insertion components may be inserted into the insertion grooves to enable the lower connection member to support the guide rails Each of the insertion grooves may have support protrusions formed on the inner surface thereof. The support protrusions may fill a gap between the inner surface of the insertion groove and the guide rail when the guide rail is inserted into the insertion groove.

The support grooves may vertically protrude from the inner surface of the insertion groove before the guide rail is inserted, and may be deformed or separated from the interior surface of the insertion groove when the guide rail is inserted, thereby filling the gap between the inner surface of the insertion groove and the lower insertion component. The driving motor may have a drum disposed therein, the drum may be configured to move or displace the cable which is partially wound around the drum.

In some exemplary embodiments, each of the guide rails may have a roller disposed at the upper portion thereof and the roller may support the cable and may be configured to control the moving direction of the cable. The lower connection member may have a roller disposed thereon. The roller may support the cable and may be configured to control the moving direction of the cable. The drum may be disposed at a location of the lower connection member, the location may be separated from the roller, and fastened to a rotating shaft of the driving motor to move the cable.

The guide rail may be formed by bending a metallic plate, and processed to have a predetermined cross-section along the longitudinal direction thereof. The upper connection member and the lower connection member may be formed through an injection-molding process using synthetic resin. The upper and lower connection members may have ribs formed thereon.

BRIEF DESCRIPTION OF THE DRAWINGS

The above and other features of the present invention will now be described in detail with reference to exemplary embodiments thereof illustrated the accompanying drawings which are given hereinbelow by way of illustration only, and thus are not limitative of the present invention, and wherein.

DETAILED DESCRIPTION

Figure 1:
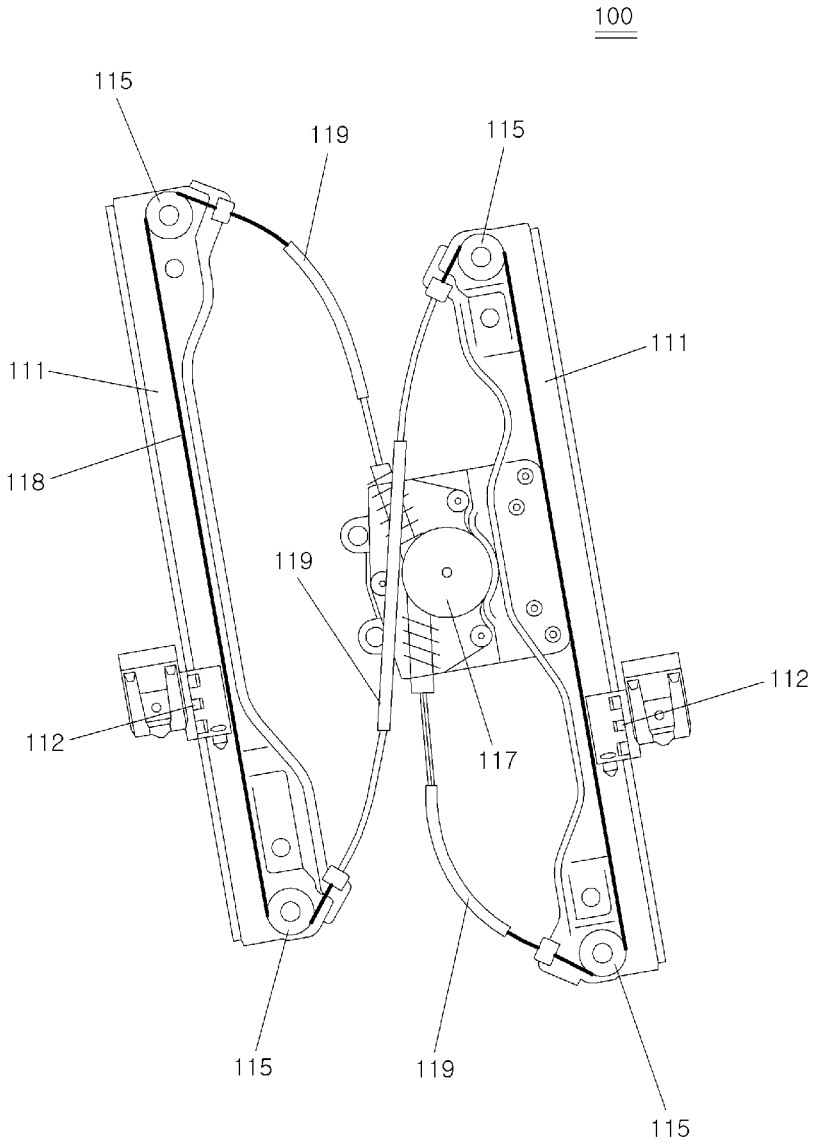
FIG. 1 is an exemplary plan view of a non-module type dual regulator assembly according to the related art.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Hereafter, a non-module type dual regulator assembly in accordance with an exemplary embodiment of the present disclosure will be described in detail with reference to the accompanying drawings.

The non-module type dual regulator assembly in accordance with the exemplary embodiment of the present disclosure may include a pair of guide rails 11, a pair of glass holders 12, an upper connection member 13, a lower connection member 14, a cable 18 and a driving motor 16. The pair of guide rails 11 may be disposed in a door of a vehicle along the direction in which a window glass G is raised and lowered, and separated from each other. The pair of glass holders 12 may be coupled to one side of the window glass G, and movably disposed on the respective guide rails 11. The upper connection member 13 may have a plurality of ends fastened to the tops of the guide rails 11, and connects the tops of the guide rails 11 separated from each other. The lower connection member 14 may have a plurality of ends fastened to the bottoms of the guide rails 11, and connects the bottoms of the guide rails 11 separated from each other. The cable 18 may be coupled to the glass holders 12, and circulatably disposed on the guide rails 11 to raise and lower the glass holders 12 in the same direction at the same time.

The driving motor 16 may be disposed in the lower connection member 14, and may be configured to circulate the cable 18.

The reason why the regulator assembly 10 in accordance with the exemplary embodiment of the present disclosure is named a non-module type dual regulator is that the regulator assembly 10 is not manufactured as a module including other door components such as a door latch and speaker as well as the regulator assembly 10, and includes the two guide rails 11 disposed therein. The pair of guide rails 11 may be disposed with a space provided therebetween. The guide rails 11 may be arranged in the direction that the window glass G is raised and lowered, and disposed with a space provided therebetween. The guide rails 11 may be configured to guide the window glass G when the window glass G is raised or lowered. The guide rails 11 may be formed through an operation of processing a metallic plate member and may include a predetermined cross-sectional shape in the direction that the window glass G is raised and lowered.

The glass holders 12 may be movably disposed on the guide rails 11. Each of the glass holders 12 may be slid along the longitudinal direction of the corresponding guide rail 11, holding one side of the guide rail 11. The glass holders 12 may be coupled to one side of the window glass G. Since the glass holders 12 are disposed on the respective guide rails 11, the window glass G may be supported at positions separated from each other by the glass holders 12, and opened or closed while being raised or lowered along the guide rails 11.

The upper connection member 13 may connect the tops of the guide rails 11 separated from each other. Since the guide rails 11 are separated from each other, a plurality of ends of the upper connection member 13 may be fastened to the tops of the guide rails 11 separated from each other, thereby connecting the tops of the guide rails 11 separated from each other. For this operation, the upper connection member 13 may include locking hooks 13*b* formed thereon, and each of the guide rails 11 may have an upper fastening aperture 11*b* formed at the top thereof to couple the locking hook 13*b* to the upper fastening aperture 11*b*. The upper connection member 13 may be coupled to the guide rails 11 through the locking hooks 13*b* locked to the upper fastening apertures 11*b*. Each of the guide rails 11 may have an upper insertion component 11*a* formed at one side of the upper portion thereof. The upper insertion component 11*a* may be formed with a flat surface because the upper insertion component 11*a* is not bent. The upper fastening aperture 11*b* may be formed through the upper insertion component 11*a*.

The upper connection member 13 may be formed through an injection-molding process using synthetic resin, and may have an insertion groove 13*a* into which the upper insertion component 11*a* is inserted. The locking hooks 13*b* may be inserted into the upper fastening apertures 11*b* of the respective guide rails 11. The upper connection member 13 may have ribs for improving the strength. In other words, the ribs may be formed in a lattice shape to improve the strength of the upper connection member 13. Since the pair of guide rails 11 are separated from each other, the upper insertion components 11*a* and the upper fastening apertures 11*b* of the respective guide rails 11 may be formed at sides facing each other. Furthermore, the insertion grooves 13*a* and the locking hooks 13*b* may be formed at a plurality of sides of the upper connection member 13, respectively.

Figure 3A:
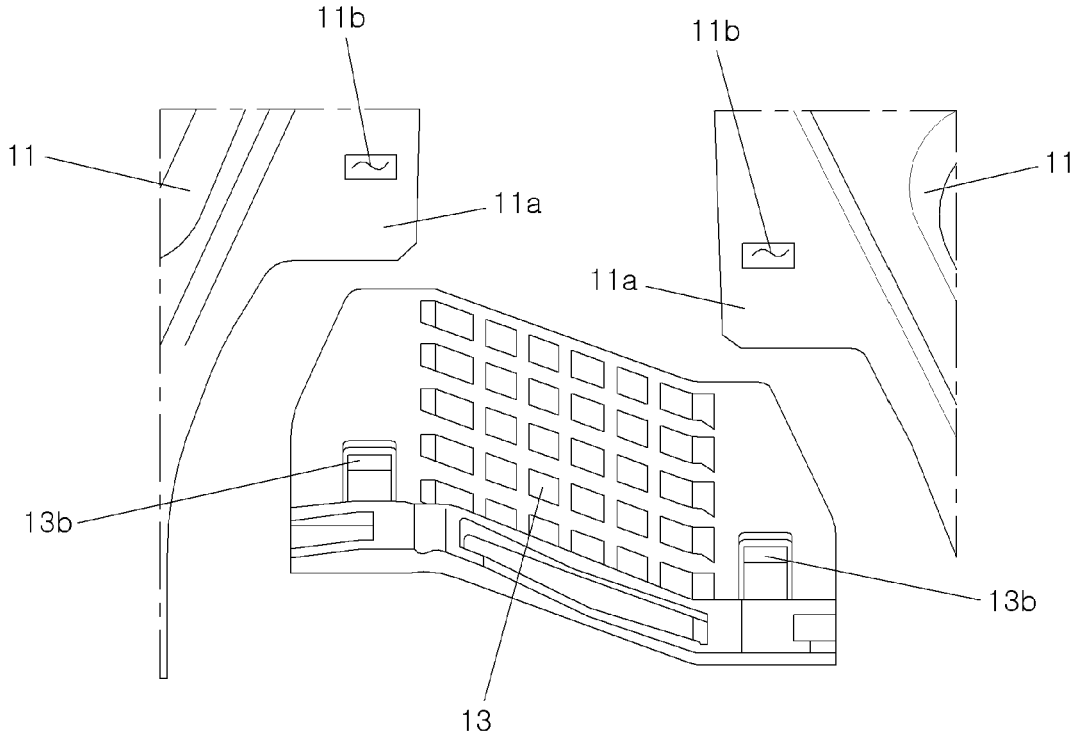
FIG. 3A illustrates the upper connection member and guide rails according to an exemplary embodiment of the present disclosure.
Figure 3B:
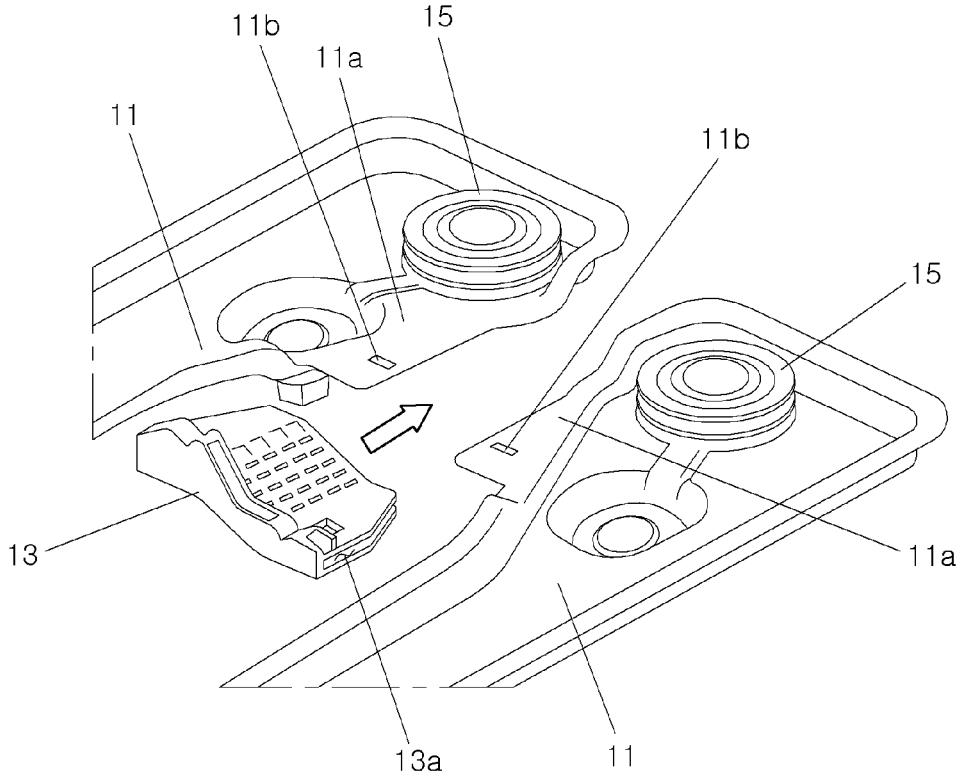
FIG. 3B illustrates a process of fastening guide rails and an upper connection member in the non-module type dual regulator assembly in accordance with an exemplary embodiment of the present disclosure.
Figure 3C:
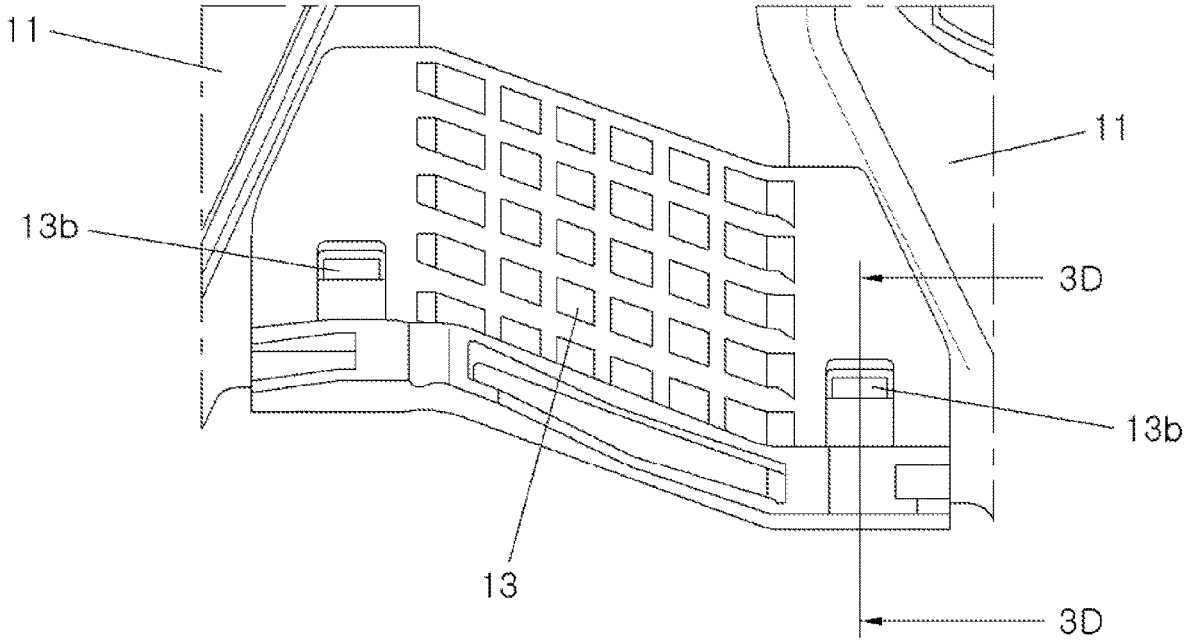
FIG. 3C illustrates the guide rails fastened to the upper connection member according to an exemplary embodiment of the present disclosure.
Figure 3D:
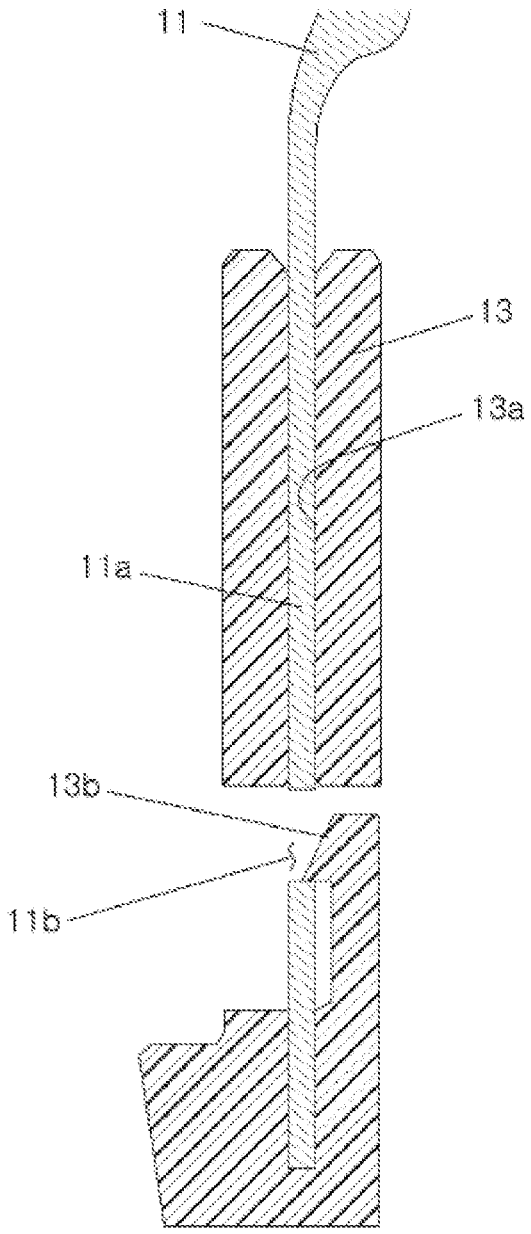
FIG. 3D illustrates a cross sectional view of FIG. 3C according to an exemplary embodiment of the present disclosure.

As illustrated in FIG. 3A or 3B, when the upper connection member 13 may be fitted to the guide rails 11 or the upper insertion components 11*a* of the guide rails 11 may be fitted into the insertion grooves 13*a* of the upper connection member 13 with the guide rails 11 separated from each other, the upper insertion components 11*a* may be inserted into the insertion grooves 13*a*. Then, when the upper insertion components 11*a* are fully inserted the locking hooks 13*b* may be locked to the upper fastening apertures 11*b*, and the upper connection member 13 and the guide rails 11 are completely assembled. As illustrated in FIG. 3D, the upper insertion components 11*a* of the guide rails 11 may be supported by the insertion grooves 13*a* of the upper connection member 13. The locking hooks 13*b* may be locked to the upper fastening apertures 11*b*. Thus, the upper connection member 13 and the guide rails 11 are not separated from each other. The lower connection member 14 may be fastened to the bottoms of the guide rails 11 separated from each other, thereby connecting the bottoms of the guide rails 11.

The method for fastening the lower connection member 14 to the guide rails 11 may be performed in a similar manner to the method for fastening the upper connection member 13 to the guide rails 11. Each of the guide rails 11 may include a lower insertion component 11*c* and a lower fastening aperture 11*d*. The lower insertion component 11*c* may be formed with a flat surface at the bottom of the guide rail 11, and the lower fastening aperture 11*d* may be formed through the lower insertion component 11*c*. The lower connection member 14 may also be formed through an injection-molding process using synthetic resin, and may have an insertion grooves 14*a* and locking hooks 14*b*. The lower insertion components 11*c* may be inserted into the respective insertion grooves 14*a*, and the locking hooks 14*b* may be fastened to the respective lower fastening apertures 11*d*.

Figure 4A:
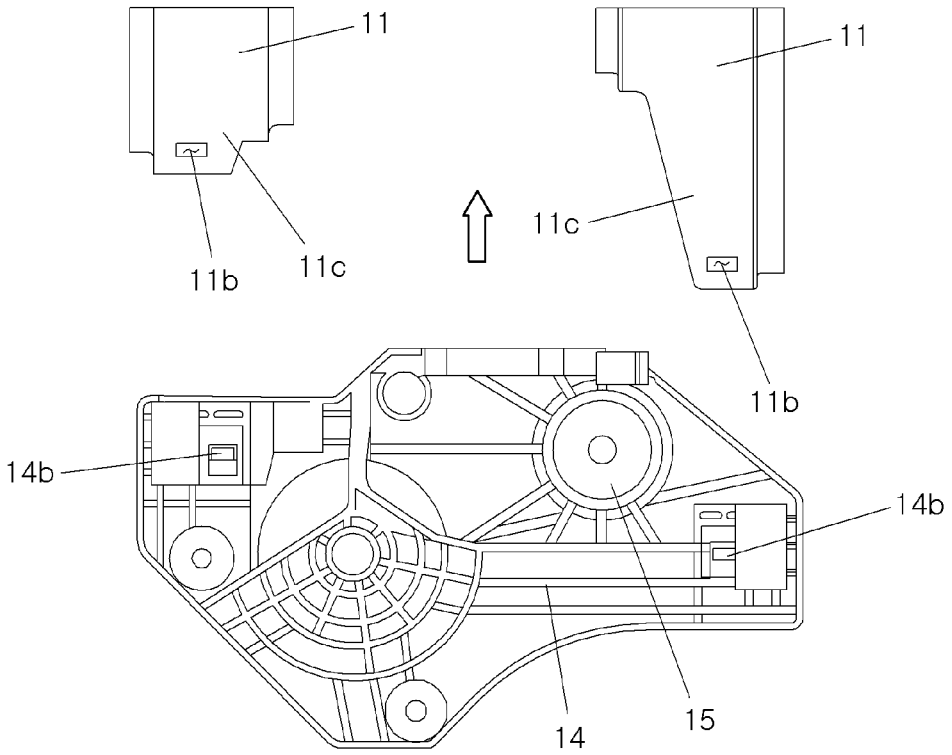
FIG. 4A illustrates an exemplary process of fastening the guide rails and a lower connection member in the non-module type dual regulator assembly in accordance with the exemplary embodiment of the present disclosure.
Figure 4B:
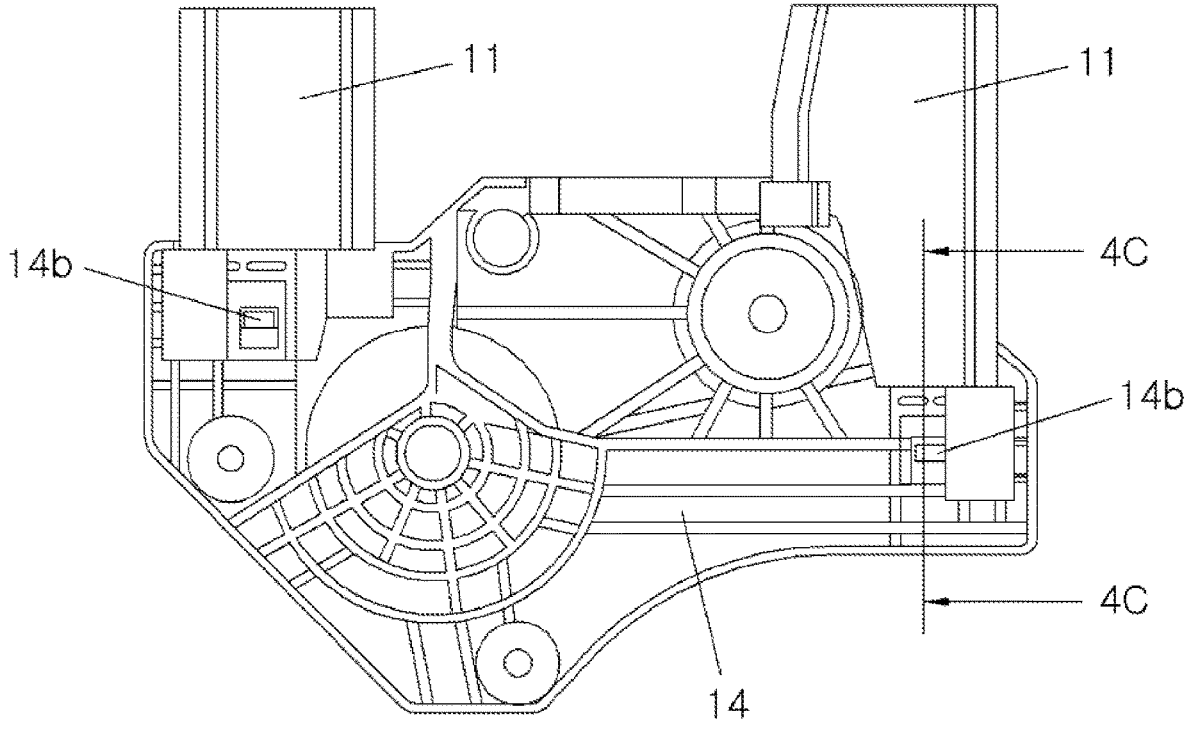
FIG. 4B illustrates the guide rails fastened to the lower connection member according to an exemplary embodiment of the present disclosure.
Figure 4C:
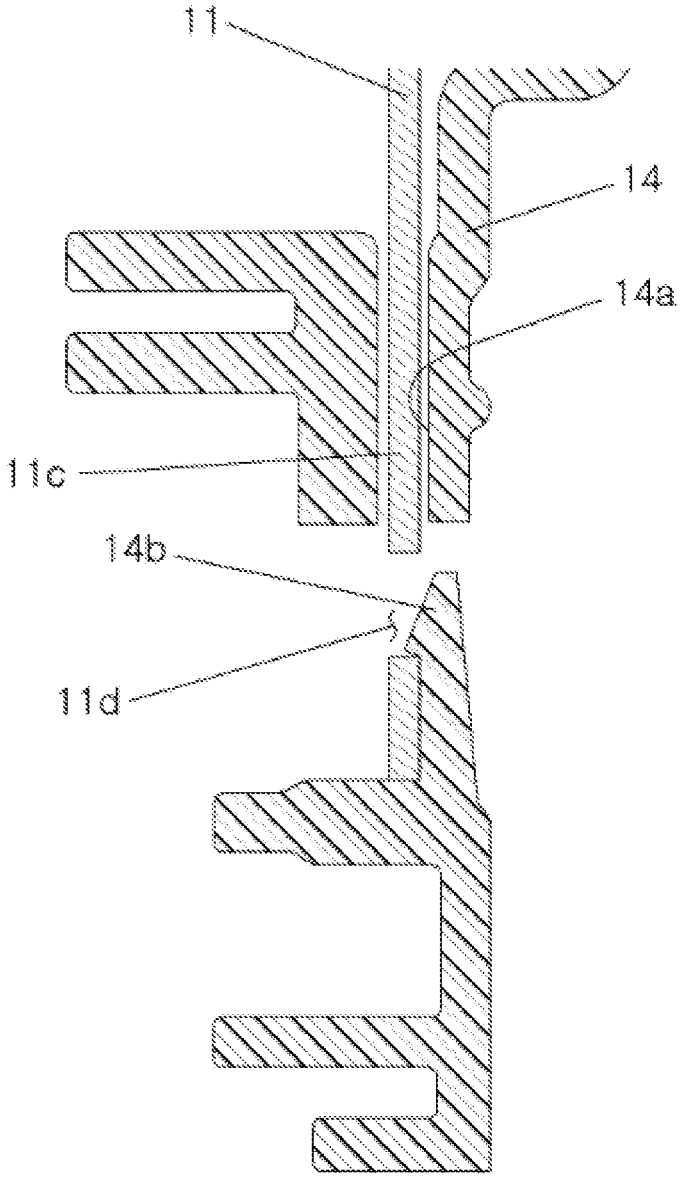
FIG. 4C illustrates a cross sectional view of FIG. 4B according to an exemplary embodiment of the present disclosure.

The lower connection member 14 may have ribs for improving the strength. Therefore, the guide rails 11 may be inserted into a plurality of front sides of the lower connection member 14, to couple the locking hooks 14*b* to the lower fastening apertures 11*d*. Then, the lower connection member 14 and the guide rails 11 may be fastened to each other. In other words, when the lower connection member 14 is fitted into the lower insertion components 11*c* of the guide rails 11 or the lower insertion components 11*c* of the guide rails 11 are inserted into the insertion grooves 14*a* of the lower connection member 14 as illustrated in FIG. 4A, the bottoms of the guide rails 11 may be fastened to the lower connection member 14 as illustrated in FIG. 4B. As illustrated in FIG. 4C, the locking hook 14*b* may be locked to the lower fastening aperture 11*d*. Thus, the lower connection member 14 and the guide rails 11 are not separated from each other, but fastened to each other (e.g., prevent from being separate).

Since the driving motor 16 described later is disposed in the lower connection member 14, the lower connection member 14 may have a size greater than the upper connection member 13. Furthermore, since the driving motor 16 is fastened to the lower connection member 14 and operated in the lower connection member 14, the fastening structure between the lower connection member 14 and the guide rails 11 may be stronger than the fastening structure between the upper connection member 13 and the guide rails 11.

Figure 5A:
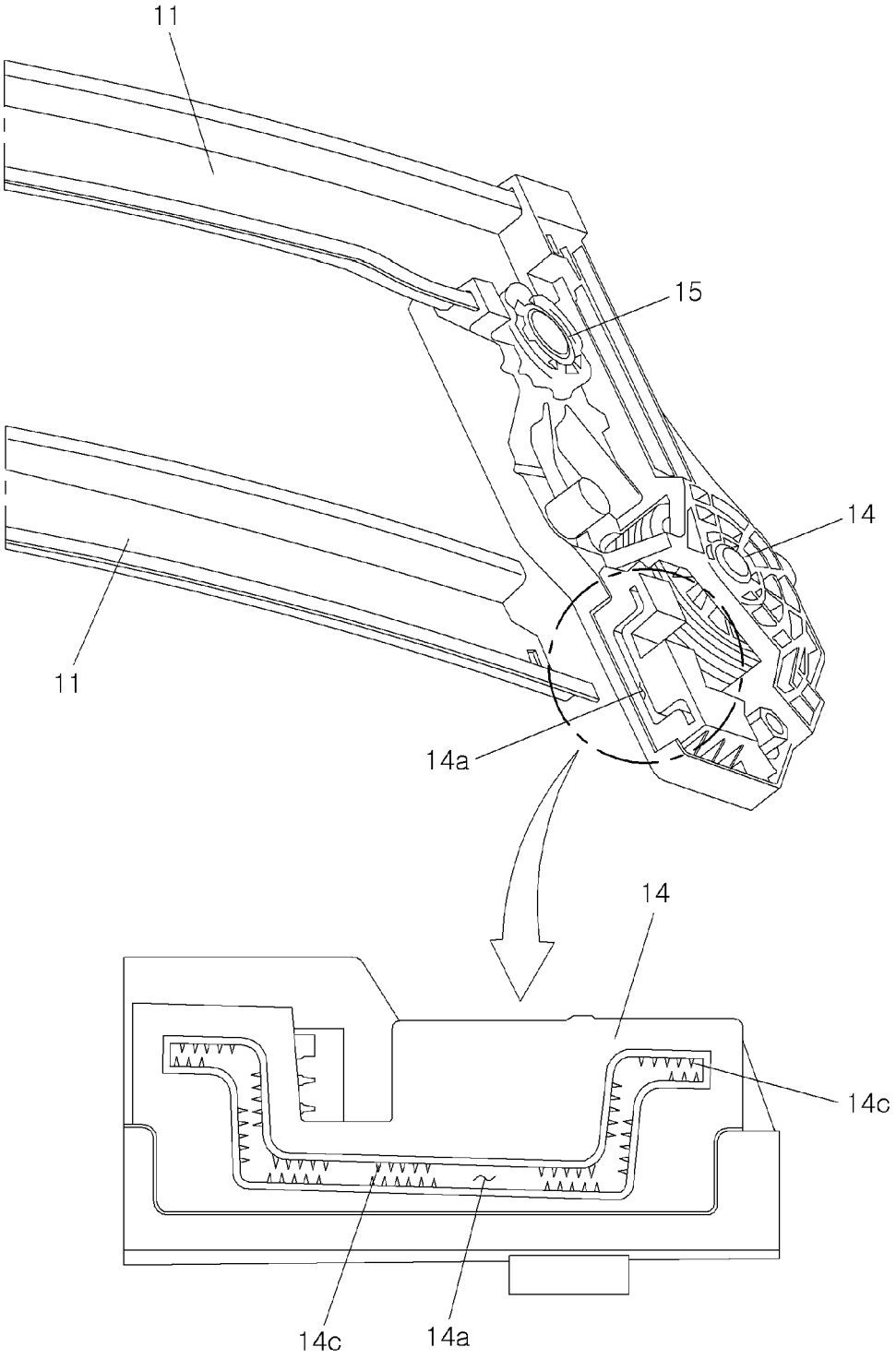
FIG. 5A is an exemplary perspective view illustrating that support protrusions are formed on an insertion groove of the lower connection member of the non-module type dual regulator assembly in accordance with an exemplary embodiment of the present disclosure, including an expanded view of a prominent component.

For this structure, as illustrated in FIG. 5A, the lower connection member 14 may have support protrusions 14*c* formed in the insertion groove 14*a* thereof, the support protrusions 14*c* vertically protruding from the inner surface of the insertion groove 14*a*. When the lower insertion component 11*c* is inserted into the insertion groove 14*a* with the support protrusions 14*c* formed on the inner surface of the insertion groove 14*a*, the support protrusions 14*c* may be deformed or separated to fill a gap between the inner surface of the insertion groove 14*a* and the lower insertion component 11*c*. Thus, when the lower connection member 14 is fastened to the guide rail 11, the fastening structure may be strengthened.

Figure 5B:
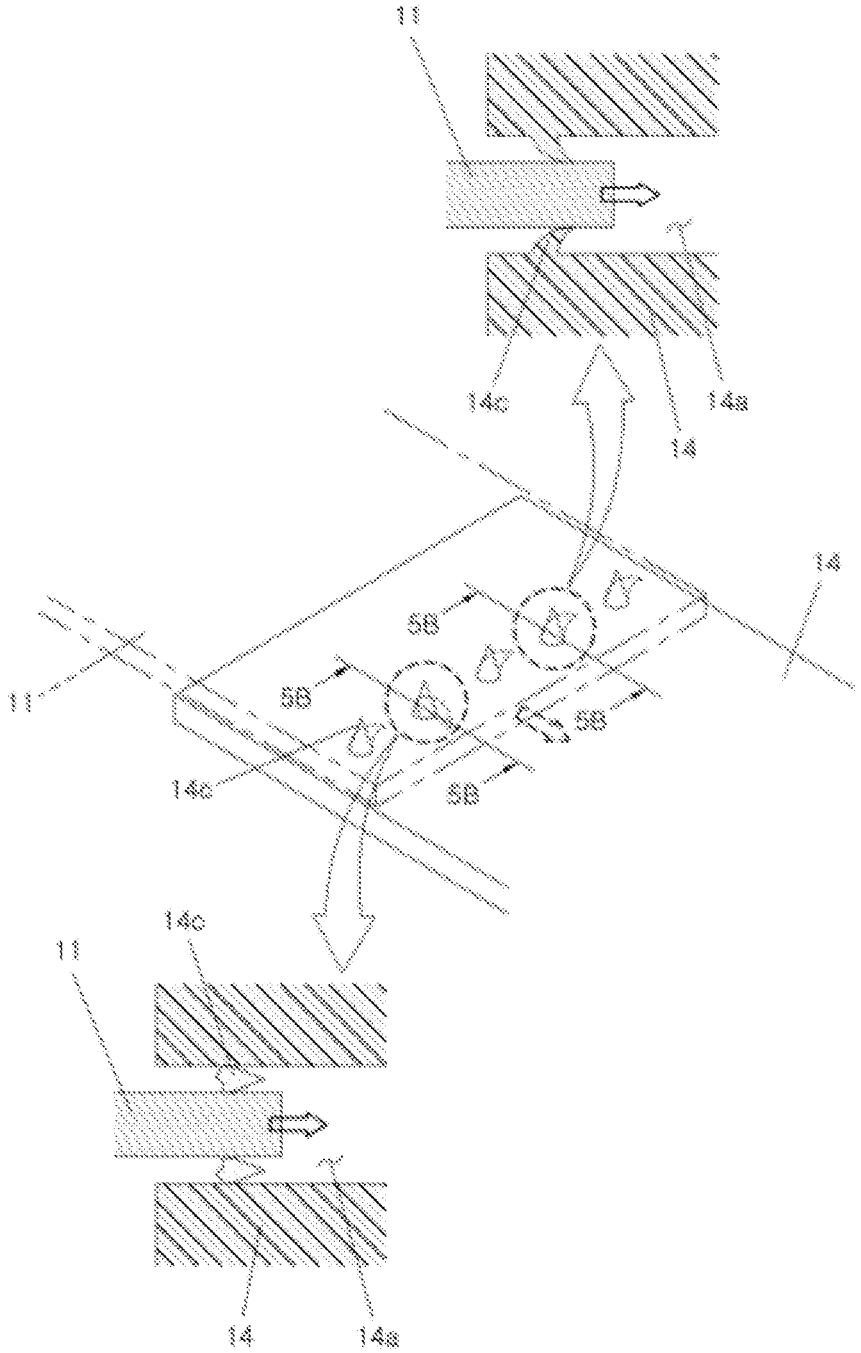
FIG. 5B is an exemplary perspective and cross-sectional views illustrating that the guide rail is inserted into the insertion groove of the lower connection member according to an exemplary embodiment of the present disclosure.

FIG. 5B illustrates that the guide rail 11 may be inserted into the insertion groove 14*a*. When the guide rail 11 is inserted into the insertion groove 14*a*, the support protrusions 14*c* that protrude toward the insertion groove 14*a* may be deformed to fill the gap between the inner surface of the insertion groove 14*a* and the lower insertion component 11*c*. At this time, a component of the support protrusions 14*c* may be bent or deformed (refer to the top of FIG. 5), and the other portion of the support protrusions 14*c* may be broken (refer to the bottom of FIG. 5), thereby filling the gap between the inner surface of the insertion groove 14*a* and the lower insertion component 11*c*.

Figure 2:
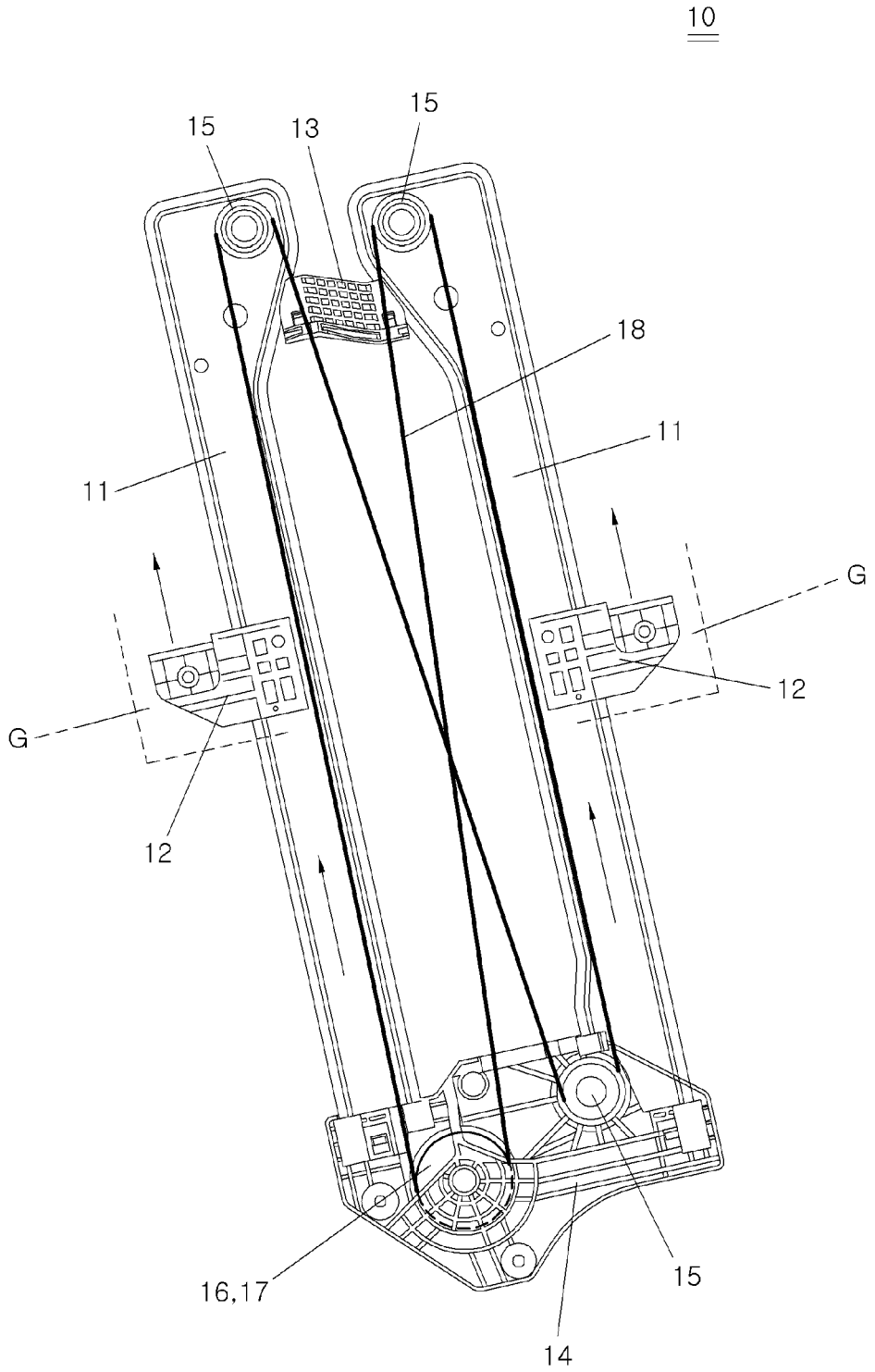
FIG. 2 is an exemplary plan view of a non-module type dual regulator assembly in accordance with an exemplary embodiment of the present disclosure.

The cable 18 may be configured to raise or lower the two glass holders 12 in the same direction as the same time. The cable 18 may be supported by the tops and bottoms of the respective guide rails 11 and coupled to the glass holders 12. The cable 18 may be disposed to cross itself between the pair of guide rails 11. Thus, the guide rails 11 may be raised or lowered in the same direction. When the cable 18 is coupled to the glass holders 12, the glass holders 12 may be configured to raise or lower the window glass G while being raised or lowered in the same direction. The rollers 15 may be disposed at the tops and bottoms of the guide rails 11, respectively to support the cable 18. In other words, as illustrated in FIG. 2, the rollers 15 may be disposed at the tops of the guide rails 11 to enable the cable 18 to pass through the rollers 15. Furthermore, the roller 15 may be disposed at the bottom of any one guide rail 11 between the two guide rails 11 or a location adjacent to the bottom of the guide rail 11.

The driving motor 16 for moving the cable 18 may be disposed at the bottom of the other guide rail 11, to enable the cable 18 to be directly wound around the driving motor 16. The driving motor 16 may be coupled to one side of the lower connection member 14. The driving motor 16 may have a drum 17 coupled to the rotating shaft thereof, and the drum 17 may be configured to move or displace the cable 18 in any one direction to raise or lower the glass holder 12.

The drum 17 may be disposed at the bottom of the guide rail 11 where the roller 15 is not disposed, between the guide rails 11, to replace the roller 15. In the related art, four rollers are required to support the cable 18. In the present exemplary embodiment, however, the drum 17 replaces one of the rollers. Accordingly, the cable 18 may be supported by three rollers 15. In FIG. 2, when the driving motor 16 and the drum 17 are rotated in the clockwise direction, the cable 18 may be configured to raise the window glass G while being moved in an arrow direction of FIG. 2. Accordingly, the drum 17 for moving the cable 18 wound therearound replaces any one of the rollers 15, thereby decreasing the number of required rollers 15. Thus, the weight of the regulator assembly 10 may be reduced.

Furthermore, the driving motor 16, the drum 17 and the roller 15 may be disposed in the lower portion of the guide rail 11. As illustrated in FIG. 2, however, the driving motor 16, the drum 17 and the roller 15 may be disposed in the lower connection member 14. Since the driving motor 16, the drum 17 and the roller 15 are disposed in the lower connection member 14, the lower connection member 14 may have a size greater than the upper connection member 13.

When the lower connection member 14 has an increased size an operator may more easily mount the regulator assembly 10 in the door. At this time, the guide rails 11 may be coated with grease for reducing friction when the glass holders 12 are moved. When the operator holds the lower and upper connection members 14 and 13 to mount the regulator assembly, the operator's hand may not be stained with the grease, which provides an improved assembling process. Furthermore, when the driving motor 16 is disposed in the lower connection member 14, the driving motor 16 may be positioned at the bottom of the door, which is displaced from a passenger. Thus, when the driving motor 16 is operated, operation noise observed by the passenger may be reduced.

In accordance with the exemplary embodiments of the present disclosure, an operator may insert the non-module type dual regulator assembly into the cavity between the inner and exterior panels of the door, holding the upper and lower connection members. In particular, operator's hand may be prevented from being stained with grease thereby providing an improved assembling process. Furthermore, since the driving motor is disposed in the lower connection member, noise may be reduced during operation. Furthermore, since the drum is disposed on the rotating shaft of the driving motor and replaces one of the rollers, the weight of the non-module type dual regulator assembly may be reduced.

While the present disclosure has been described with respect to the exemplary embodiments, it will be apparent to those skilled in the art that various changes and modifications may be made without departing from the spirit and scope of the disclosure as defined in the following claims.

What is claimed is:

1. A dual regulator assembly, comprising:

a pair of guide rails separated from each other and disposed in a door of a vehicle, the pair of guide rails extending in a direction that a window glass of the assembly is raised or lowered;

a pair of glass holders coupled to one side of the window glass, and each one of the pair of glass holders is slidably engaged with a respective one of the guide rails;

an upper connection member having a pair of ends mounted on upper portions of the guide rails and connecting the upper portions of the guide rails;

a lower connection member having a pair of ends mounted on lower portions of the guide rails and connecting the lower portions of the guide rails;

a cable coupled to the glass holders and disposed along the guide rails to raise or lower the glass holders simultaneously; and a driving motor disposed on the lower connection member and configured to drive the cable, wherein the driving motor has a drum disposed thereon, and the drum is configured to drive the cable which is partially wound around the drum, and wherein each of the guide rails has an upper roller disposed on the upper portion thereof, the upper rollers support the cable and reverse a moving direction of the cable, wherein a first one of the pair of ends of the lower connection member has a lower roller disposed thereon, the lower roller supports the cable and reverses the moving direction of the cable, wherein the drum is disposed on a second one of the pair of ends of the lower connection member, the drum is coupled to a rotating shaft of the driving motor, and the drum supports the cable and reverses the moving direction of the cable, wherein the drum and the lower roller are the only two elements disposed on the lower connection member for changing the moving direction of the cable, and wherein the lower roller and the drum are spaced apart from each other.

2. The dual regulator assembly of claim 1, wherein each of the guide rails has an upper fastening aperture extending through the upper portion thereof, the upper connection member has locking hooks formed at the ends thereof; and the locking hooks are inserted and locked into the upper fastening apertures of the guide rails to couple the guide rails and the upper connection member to each other.

3. The dual regulator assembly of claim 2, wherein each of the guide rails has a flat surface on the upper portion thereof, the upper connection member has insertion grooves into which the flat surfaces are inserted to enable the upper connection member to support the guide rails.

4. The dual regulator assembly of claim 1, wherein each of the guide rails has a lower fastening aperture extending through the lower portion thereof, the lower connection member has locking hooks formed at the ends thereof, and the locking hooks are inserted into and fastened to the lower fastening apertures of the guide rails to couple the guide rails and the lower connection member to each other.

5. The dual regulator assembly of claim 4, wherein each of the guide rails has a flat surface on the lower portion thereof, the lower connection member has insertion grooves into which the flat surfaces are inserted such that the lower connection member supports the guide rails.

6. The dual regulator assembly of claim 5, wherein each of the insertion grooves has support protrusions filling a gap between the insertion groove and a respective one of the guide rails when inserted therein.

7. The dual regulator assembly of claim 6, wherein the support protrusions are separated from the insertion grooves when the guide rails are inserted therein.

8. The dual regulator assembly of claim 1, wherein each of the guide rails is formed by bending a metallic plate, and the upper connection member and the lower connection member are each formed through an injection-molding process using synthetic resin.

9. The dual regulator assembly of claim 8, wherein the upper and lower connection members have ribs formed thereon.

* * * * *